US009274446B2

(12) United States Patent
Kawauchi

(10) Patent No.: US 9,274,446 B2
(45) Date of Patent: Mar. 1, 2016

(54) METHOD FOR MANUFACTURING CARRIER CORE PARTICLES FOR ELECTROPHOTOGRAPHIC DEVELOPER

(71) Applicants: DOWA ELECTRONICS MATERIALS CO., LTD., Tokyo (JP); DOWA IP CREATION CO., LTD., Okayama (JP)

(72) Inventor: Takeshi Kawauchi, Okayama (JP)

(73) Assignees: DOWA ELECTRONICS MATERIALS CO., LTD., Tokyo (JP); DOWA IP CREATION CO., LTD., Okayama (JP)

( * ) Notice: Subject to any disclaimer, the term of this patent is extended or adjusted under 35 U.S.C. 154(b) by 0 days.

(21) Appl. No.: 14/112,960

(22) PCT Filed: Nov. 30, 2012

(86) PCT No.: PCT/JP2012/081085
§ 371 (c)(1),
(2) Date: Oct. 21, 2013

(87) PCT Pub. No.: WO2013/145447
PCT Pub. Date: Oct. 3, 2013

(65) Prior Publication Data

US 2015/0044607 A1 Feb. 12, 2015

(30) Foreign Application Priority Data

Mar. 29, 2012 (JP) ..... 2012-077720

(51) Int. Cl.
*G03G 9/107* (2006.01)
*G03G 9/113* (2006.01)
*G03G 9/08* (2006.01)

(52) U.S. Cl.
CPC ..... *G03G 9/107* (2013.01); *G03G 9/0812* (2013.01); *G03G 9/1075* (2013.01); *G03G 9/1131* (2013.01); *G03G 9/1132* (2013.01)

(58) Field of Classification Search
CPC ..... G03G 9/107; G03G 9/1075; G03G 9/113
USPC ..... 430/111.3, 111.31, 111.32, 111.33, 430/111.34, 111.35, 137.1, 137.13
See application file for complete search history.

(56) References Cited

U.S. PATENT DOCUMENTS

2011/0212399 A1* 9/2011 Suwa et al. ..... 430/111.32

FOREIGN PATENT DOCUMENTS

| | | | |
|---|---|---|---|
| JP | 9-127737 | | 5/1997 |
| JP | 9-281752 | | 10/1997 |
| JP | 2003-280281 | A1 * | 10/2003 |
| JP | 2006-337828 | | 12/2006 |
| JP | 2009-186849 | | 8/2009 |
| JP | 2010-097171 | | 4/2010 |
| JP | 2011-154288 | | 8/2011 |
| JP | 2011-164225 | | 8/2011 |
| JP | 2012-048256 | | 3/2012 |

OTHER PUBLICATIONS

Grant, R. et al., ed., Grant & Hackh's Chemical Dictionary, fifth edition, McGraw-Hill Book Company, NY (1987), pp. 56, 122 and 372.*

European Patent Office machine-assisted English-language translation of JP 2003-280281 (pub. Oct. 2003).*

* cited by examiner

*Primary Examiner* — Janis L Dote
(74) *Attorney, Agent, or Firm* — Clark & Brody

(57) ABSTRACT

A method for manufacturing carrier core particles for electrophotographic developer that include manganese, magnesium, and iron as a core composition. The method includes a granulation step (A) of granulating a mixture of raw materials containing manganese, magnesium, and iron with a reducing agent added at a ratio of 0.10% to 1.00% by mass to a total mass of the raw materials containing manganese, magnesium, and iron, and a firing step of firing the granular material granulated in the granulation step. The firing step includes a first heating step (C) of applying heat at a constant temperature ranging from 500° C. to 800° C. in an atmosphere with an oxygen concentration of 1000 ppm to 15000 ppm for a predetermined period of time and a second heating step (D) of applying heat at a temperature higher than 800° C. for a predetermined period of time after the first heating step.

5 Claims, 6 Drawing Sheets

METHOD FOR MANUFACTURING CARRIER CORE PARTICLES FOR ELECTROPHOTOGRAPHIC DEVELOPER

TECHNICAL FIELD

This invention relates to a method for manufacturing carrier core particles for electrophotographic developer (hereinafter, sometimes simply referred to as "carrier core particles"), the carrier core particles for electrophotographic developer, carrier for electrophotographic developer (hereinafter, sometimes simply referred to as "carrier"), and electrophotographic developer (hereinafter, sometimes simply referred to as "developer"). More particularly, this invention relates to carrier core particles contained in electrophotographic developer used in copying machines, MFPs (Multifunctional Printers) or other types of electrophotographic apparatuses, a method for manufacturing the carrier core particles, carrier in the electrophotographic developer and the electrophotographic developer.

BACKGROUND ART

Electrophotographic dry developing systems employed in copying machines, MFPs or other types of electrophotographic apparatuses are categorized into a system using a one-component developer containing only toner and a system using a two-component developer containing toner and carrier. In either of these developing systems, toner charged to a predetermined level is applied to a photoreceptor. An electrostatic latent image formed on the photoreceptor is rendered visual with the toner and is transferred to a sheet of paper. The image visualized by the toner is fixed on the paper to obtain a desired image.

A brief description about development with the two-component developer will be given. A predetermined amount of toner and a predetermined amount of carrier are accommodated in a developing apparatus. The developing apparatus is provided with a rotatable magnet roller with a plurality of south and north poles alternately arranged thereon in the circumferential direction and an agitation roller for agitating and mixing the toner and carrier in the developing apparatus. The carrier made of a magnetic powder is carried by the magnet roller. The magnetic force of the magnet roller forms a straight-chain-like magnetic brush of carrier particles. Agitation produces triboelectric charges that attract a plurality of toner particles to the surfaces of the carrier particles. The magnetic brush abuts against the photoreceptor with rotation of the magnet roller to supply the toner to the surface of the photoreceptor. Development with the two-component developer is carried out as described above.

Fixation of the toner on a sheet of paper results in successive consumption of toner in the developing apparatus, and new toner in the same amount as that of the consumed toner is supplied, whenever needed, from a toner hopper attached to the developing apparatus. On the other hand, the carrier is not consumed for development and is used as it is until the carrier comes to the end of its life. The carrier, which is a component of the two-component developer, is required to have various functions including: capability of triboelectrically charging the toner by agitation in an effective manner; insulation properties; and a toner transferring ability to appropriately transfer the toner to the photoreceptor. To improve the toner charging characteristics, for example, the carrier is especially required to have appropriate electric resistance (hereinafter, sometimes simply referred to as "resistance") and appropriate insulation properties.

The recently dominating carrier includes carrier core particles, which are the core or the heart of the carrier particles, and coating resin that covers the surface of the carrier core particles. Technologies relating to the carrier core particles are disclosed in Japanese Unexamined Patent Application Publication No. 2006-337828 (PTL 1) and Japanese Patent Publication No. 3463840 (PTL 2).

CITATION LIST

Patent Literature

PTL1: Japanese Unexamined Patent Application Publication No. 2006-337828
PTL2: Japanese Patent No. 3463840

SUMMARY OF THE INVENTION

Technical Problem

The carrier core particles are covered with coating resin as described above. This coating resin imparts main characteristics, such as toner charging characteristics, to the carrier. The carrier core particles before being covered with the coating resin are also required to have a function of effectively charging the toner with triboelectric charging, i.e., high toner charging characteristics.

This requirement is derived from the following concern, for example. A developer obtained by agitating and mixing a predetermined amount of carrier and a predetermined amount of toner delivers good image quality and good development characteristics at the beginning of the use due to the coating resin's characteristics. However, if the carrier continues to be used in the developing apparatus without replacement along with a long use of the developer, the coating resin may be partially peeled off or the carrier core particles may become chipped or fractured, which expose the bare parts of the carrier. If that happens, the characteristics of the carrier core particles, that is, the toner charging characteristics of the carrier core particles directly affect the image quality and development characteristics. Therefore, the carrier core particles are required to have good toner charging characteristics to achieve long-lasting excellent image quality.

The carrier core particles are also required to have high physical strength for the purpose of using them as a part of carrier for a long time in the developing apparatus. It is highly possible for the carrier core particles with low physical strength to fracture or chip during long-term use. The fracture or chipping may deteriorate the toner charging characteristics, which affects the quality of formed images.

The conventional carrier core particles as disclosed in PTLs 1 and 2 are sometimes unsatisfactory for long-term use. For example, conventional developer delivers a certain degree of performance at the beginning of the use; however, the carrier core particles in the developer may become fractured or chipped or the coating resin may be peeled off relatively more often with the long use of the developer, which induces problems such as quality degradation of formed images.

An object of the present invention is to provide a method for manufacturing carrier core particles for electrophotographic developer capable of forming good images over long-term use.

Yet another object of the present invention is to provide carrier core particles for electrophotographic developer capable of forming good images over long-term use.

Yet another object of the present invention is to provide carrier for electrophotographic developer capable of forming good images over long-term use.

Yet still another object of the present invention is to provide electrophotographic developer capable of forming good images over long-term use.

Solution to Problem

The inventors of the present invention first contemplated the use of manganese, magnesium, and iron as main ingredients to impart excellent magnetic characteristics to the carrier core particles. Carrier core particles mainly made of manganese, magnesium, and iron exhibit excellent magnetic characteristics. In addition, such carrier core particles also basically deliver excellent electrical characteristics. The inventors then considered the ways of forming appropriate irregularities on the surface of the carrier core particles in order to increase the surface area to enhance triboelectric charging characteristics and of reducing the possibility of the coating resin from being peeled off. Furthermore, the inventors tried to improve the physical strength of the carrier core particles by eliminating internal gaps and voids in the carrier core particles as much as possible while forming the appropriate irregularities on the surface of the carrier core particles. In short, the inventors tried to obtain carrier core particles less susceptible to fracture and chipping even when they have been under load caused by agitation or the like in the developing apparatus for a long time. After keen examination, what the inventors focused on in order to form appropriate irregularities on the surface of the carrier core particles and reduce the internal gaps and voids inside the carrier core particles was the effects of additives and atmosphere in a sintering step in the course of manufacturing the carrier core particles. Then, the inventors have reached the constituent features of the invention to achieve both the formation of appropriate irregularities on the surface of the carrier core particles and reduction of internal gaps and voids in the carrier core particles.

The present invention is directed to a method for manufacturing carrier core particles for electrophotographic developer which include manganese, magnesium, and iron as a core composition. The method includes a granulation step of granulating a mixture of a raw material containing manganese, a raw material containing magnesium, and a raw material containing iron with a reducing agent added at a ratio of 0.10% to 1.00% by mass to the total mass of the raw materials containing manganese, magnesium, and iron, and a firing step of firing the granular material granulated in the granulation step. The firing step includes a first heating step of applying heat at a constant temperature ranging from 500° C. to 800° C. in an atmosphere with an oxygen concentration of 1000 ppm to 15000 ppm for a predetermined period of time and a second heating step of applying heat at a temperature higher than 800° C. for a predetermined period of time after the first heating step.

The carrier core particles manufactured through the above described method contain manganese, magnesium, and iron as a core composition and therefore exhibit excellent magnetic characteristics as well as excellent electrical characteristics. In addition, the method includes the granulation step of granulating a mixture of a raw material containing manganese, a raw material containing magnesium, and a raw material containing iron with a reducing agent added at a ratio of 0.10% to 1.00% by mass to the total mass of the raw materials containing manganese, magnesium, and iron and a firing step of firing the granular material granulated in the granulation step, wherein the firing step includes the first heating step of applying heat at a constant temperature ranging from 500° C. to 800° C. in an atmosphere with an oxygen concentration of 1000 ppm to 15000 ppm for a predetermined period of time and the second heating step of applying heat at a temperature higher than 800° C. for a predetermined period of time after the first heating step, thereby promoting ferrite reaction in part of each particle in the first heating step. After promotion of the ferrite reaction in part of the particles, most parts of the particles can be sintered in the second heating step. The two heating steps can sufficiently promote sintering of the inner part of the carrier core particles and form appropriate irregularities on the surface of the carrier core particles.

Thus obtained carrier core particles have high physical strength and appropriate irregularities thereover. Therefore, the carrier core particles are less susceptible to fracture and chipping, make the coating resin resistant to peeling, and can maintain high toner charging characteristics for a long time. Such carrier core particles for electrophotographic developer can deliver excellent properties not only at the beginning but also over the long run without property degradation. Consequently, the method for manufacturing the carrier core particles for electrophotographic developer can manufacture carrier core particles for electrophotographic developer that can form good images over long-term use.

The reducing agent can be anything as long as it can promote reduction reaction at a temperature ranging from 500° C. to 800° C. and may contain a raw material containing carbon. The raw material containing carbon may include carbon black. Such a reducing agent can promote reduction reaction in a more proper way.

The carrier core particles for electrophotographic developer may contain calcium as a core composition. The carrier core particles containing calcium can further enhance their charging characteristics.

The heating temperature in the second heating step may be set to 1000° C. to 1150° C. The temperature in that range can more reliably promote sintering.

In another aspect of the present invention, the carrier core particles for electrophotographic developer contain manganese, magnesium, and iron as a core composition and have a pore volume of from 0.005 $cm^3/g$ to 0.020 $cm^3/g$ and a BET specific surface area of from 0.140 $m^2/g$ to 0.230 $m^2/g$.

The carrier core particles containing manganese, iron, and magnesium as main ingredients are excellent in magnetic characteristics and electrical characteristics. In addition, the pore volume in a range from 0.005 $cm^3/g$ to 0.020 $cm^3/g$ and the BET specific surface area in a range from 0.140 $m^2/g$ to 0.230 $m^2/g$ demonstrate that the carrier core particles have a higher value of BET specific surface area than conventional carrier core particles even though the pore volume of the inner part of the carrier core particles of the present invention is sufficiently small. Such carrier core particles have surfaces with appropriate irregularities and sufficiently sintered inner parts and therefore have sufficiently high physical strength. Typical carrier core particles can be expressed by a general formula: $Mn_xMg_yFe_{3-x-y}O_4$ ($0 \le x \le 1$, $0 \le y \le 1$), and more preferably $0.6<x<0.9$, $0.1<y<0.35$.

When the carrier core particles are pulverized and the true density of the carrier core particles before pulverization is expressed by $\rho 1$ and the true density of the carrier core particles after pulverization is expressed by $\rho 2$, the volume porosity P calculated by $P(\%)=(\rho 2-\rho 1)\times 100/\rho 2$ may be controlled to be 4.5% or lower.

In yet another aspect of the present invention, the carrier core particles for electrophotographic developer are manufactured by granulating a mixture of a raw material containing manganese, a raw material containing magnesium, and a raw material containing iron with a reducing agent added at a ratio of 0.10% to 1.00% by mass to a total mass of the raw materials containing manganese, magnesium, and iron, and applying heat to the granular material at a constant temperature ranging from 500° C. to 800° C. in an atmosphere with an oxygen concentration of 1000 ppm to 15000 ppm for a predetermined period of time and subsequently applying heat to the granular material at a temperature higher than 800° C. for a predetermined period of time.

The carrier core particles for electrophotographic developer manufactured in the aforementioned method can form good images over long-term use.

In addition, the carrier core particles may contain calcium as a core composition. The carrier core particles containing calcium can enhance their toner charging characteristics.

In yet another aspect of the invention, carrier for electrophotographic developer that is used in developer to develop electrophotographic images includes any of the aforementioned carrier core particles for electrophotographic developer and resin that coats the surface of the carrier core particles for electrophotographic developer.

The carrier for electrophotographic developer can form good images over long-term use.

In still yet another aspect of the present invention, electrophotographic developer that is used to develop electrophotographic images includes the carrier for electrophotographic developer and toner that can be triboelectrically charged by frictional contact with the carrier for development of electrophotographic images.

The electrophotographic developer can form good images over long-term use.

Advantageous Effects of Invention

The method for manufacturing the carrier core particles for electrophotographic developer according to the invention can manufacture carrier core particles for electrophotographic developer that can provide good images over long-term use.

In addition, the carrier core particles for electrophotographic developer according to the invention can provide good images over long-term use.

In addition, the carrier for electrophotographic developer according to the invention can provide good images over long-term use.

In addition, the electrophotographic developer according to the invention can provide good images over long-term use.

DESCRIPTION OF EMBODIMENTS

Figure 1:
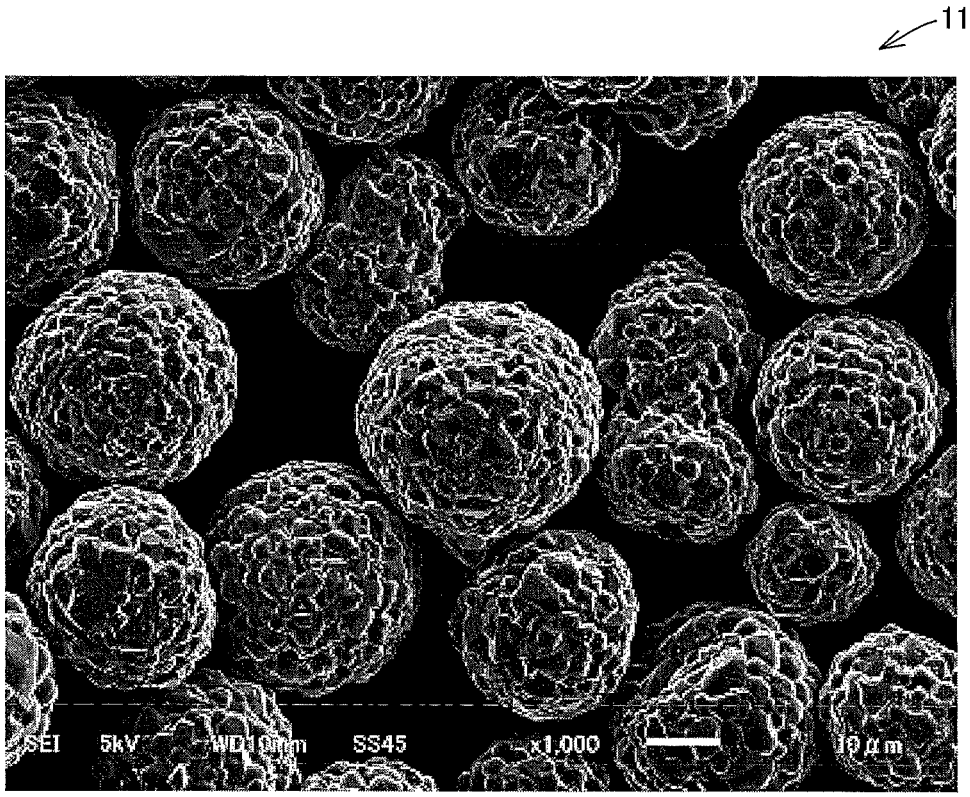
FIG. 1 is an electron micrograph showing the appearance of carrier core particles of Example 1.

An embodiment of the present invention will be described below with reference to the drawings. First, a description about carrier core particles according to the embodiment of the invention will be given. FIG. 1 is an electron micrograph showing the appearance of carrier core particles according to the embodiment of the invention.

With reference to FIG. 1, the carrier core particles 11 according to the embodiment of the invention are roughly spherical in shape. The carrier core particles 11 according to the embodiment of the invention have a diameter of approximately 35 μm and an appropriate particle size distribution. The particle diameter refers to volume mean diameter. The particle diameter and particle size distribution are set to any values to meet required characteristics and manufacturing yield of the developer. On the surface of the carrier core particles 11, there are fine irregularities that are formed mainly in a sintering step, which will be described later.

Carrier particles according to the embodiment of the invention are not shown in the drawings, but are also roughly spherical in shape like the carrier core particles 11. The carrier particles are made by coating, or covering, the carrier core particles 11 with a thin resin film and have almost the same diameter as the carrier core particles 11. The surfaces of the carrier particles are almost completely covered with resin, which is different from the carrier core particles 11.

Electrophotographic developer according to the embodiment of the invention includes the aforementioned carrier and toner. Toner particles are also roughly spherical in shape. The toner particles contain mainly styrene acrylic-based resin or polyester-based resin and a predetermined amount of pigment, wax and other ingredients combined therewith. Such toner particles are manufactured by, for example, a pulverizing method or polymerizing method. The toner particles in use are, for example, approximately 5 μm in diameter, which is about one-seventh of the diameter of the carrier particles. The compounding ratio of the toner and carrier is also set to any value according to the required developer characteristics. Such developer is manufactured by mixing a predetermined amount of the carrier and toner by a suitable mixer.

Figure 2:
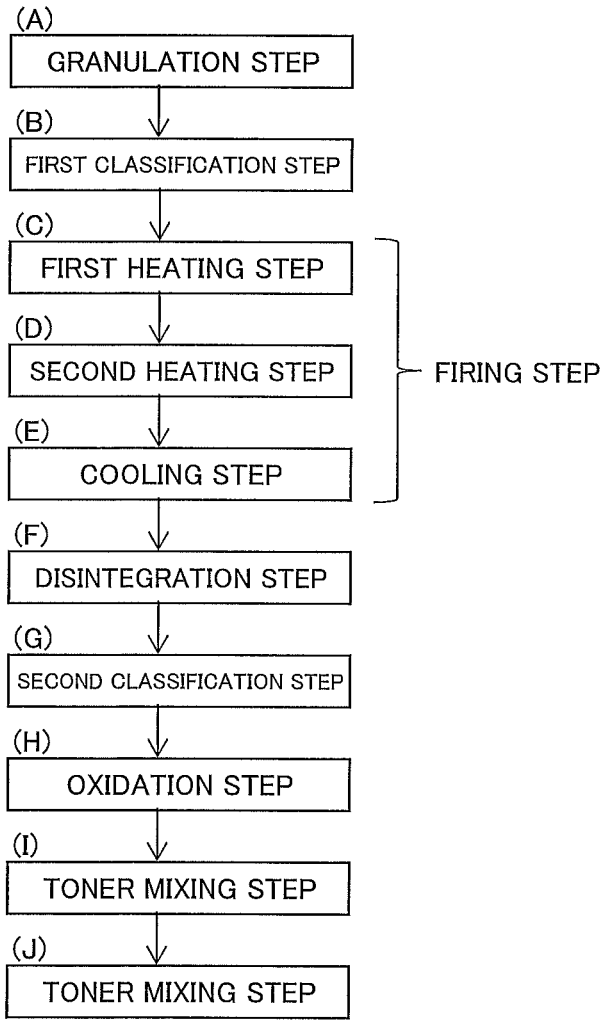
FIG. 2 is a flowchart showing representative steps of the method for manufacturing the carrier core particles according to an embodiment of the present invention.

Next, a method for manufacturing the carrier core particles according to the embodiment of the invention will be described. FIG. 2 is a flowchart showing representative steps of the method for manufacturing the carrier core particles according to the embodiment of the invention. Along FIG. 2, the method for manufacturing the carrier core particles according to the invention will be described below.

First, a raw material containing manganese, a raw material containing magnesium, a raw material containing calcium, and a raw material containing iron are prepared. These raw materials may have been calcined. The calcination is carried out, for example, by heating the raw materials in air atmosphere at a temperature of from 800° C. to 1100° C. for 1 to 10 hours.

The prepared raw materials are formulated at an appropriate compounding ratio to meet the required characteristics, and then mixed. The iron-containing raw material making up the carrier core particles according to the embodiment of the invention can be metallic iron or an oxide thereof, and more specifically, preferred materials include $Fe_2O_3$, $Fe_3O_4$ and Fe, which can stably exist at room temperature and atmospheric pressure. The manganese-containing raw material can be manganese metal or an oxide thereof, and more specifically, preferred materials include Mn metal, $MnO_2$, $Mn_2O_3$, $Mn_3O_4$ and $MnCO_3$, which can stably exist at room temperature and atmospheric pressure. The calcium-containing raw material can be calcium metal or an oxide thereof, and more specifically, preferred materials include, for example, $CaCO_3$, which is a carbonate, $Ca(OH)_2$, which is a hydroxide, and CaO, which is an oxide. The magnesium-containing raw material can be magnesium metal or an oxide thereof, and more specifically, preferred materials include, for example, $MgCO_3$, which is a carbonate, $Mg(OH)_2$, which is a hydroxide, and MgO, which is an oxide. The raw materials (iron raw material, manganese raw material, calcium raw material, magnesium raw material, etc.) can be calcined and pulverized individually or all together after being mixed so as to have the target composition. Note that the iron raw material and manganese raw material contain an infinitesimal amount of magnesium.

Then, the mixed materials are slurried. Specifically, the materials are weighed out to meet the target composition of the carrier core particles and are mixed to obtain a slurried material.

At this stage of the method for manufacturing the carrier core particles according to the present invention, a reducing agent is added to the slurried material in order to promote partial ferrite reaction of the particles in a first heating step, which will be described later. A preferred reducing agent may be carbon black, carbon powder, polycarboxylic acid-based organic substance, polyacrylic acid-based organic substance, maleic acid, acetic acid, polyvinyl alcohol (PVA)-based organic substance, or mixtures thereof.

The reducing agent is added to the slurried material at a ratio from 0.10% to 1.00% by mass to the total mass of the raw materials containing manganese, magnesium, calcium, and iron. When the content of the reducing agent is 0.10% by mass or more, the first heating step promotes ferrite reaction in parts of the particles and the subsequent second heating step sufficiently sinters inner parts of the particles while transforming the crystal on the surface of the particles into fine irregularities. Therefore, 0.10% by mass or higher is preferable. When the content of the reducing agent is 1.00% by mass or less, the first heating step completely ferritizes parts of the particles and the particles are prevented from being smooth without development of crystalline irregularities on the surface and from being sintered with a large number of gaps and voids left in the grain boundaries in the subsequent second heating step. Therefore, 1.00% by mass or lower is preferable.

Water is added to the slurried material that is then mixed and agitated so as to adjust the solid concentration to 40% by mass or higher, preferably 50% by mass or higher. The slurried material containing 50% by mass or higher solid is preferable because such a material can maintain strength when it is granulated into pellets.

Subsequently, the slurried material is granulated (FIG. 2(A)). Specifically, the raw materials containing manganese, magnesium, calcium, and iron are mixed with the reducing agent added at a ratio of 0.10% to 1.00% by mass to the total mass of the raw materials containing manganese, magnesium, calcium, and iron, and the mixed material is then granulated. Granulation of the slurry obtained by mixing and agitation is performed with a spray drier. Note that it may be preferable to subject the slurry to wet pulverization before the granulation step. If the calcium-containing raw material is not added, the total mass is the sum in masses of the raw materials containing manganese, magnesium, and iron. This means that in the granulation step, a raw material containing manganese, a raw material containing magnesium, and a raw material containing iron are mixed with a reducing agent at a ratio of 0.10% to 1.00% by mass to the total mass of the raw materials containing manganese, magnesium, and iron, and the mixed material is then granulated.

The temperature of an atmosphere during spray drying can be set to approximately 100° C. to 300° C. This can provide granulated powder whose particles are approximately 10 to 200 μm in diameter. In consideration of the final diameter of the particles as a product, the obtained granulated powder is filtered by a vibrating sieve or the like to remove coarse particles and fine powder for particle size adjustment at this point of time. This process is so-called classification. This classification step is a first classification step (FIG. 2 (B)).

Subsequently, the granular material is fired. The firing step includes a first heating step carried out at a constant temperature ranging from 500° C. to 800° C., under an atmosphere with an oxygen concentration of 1000 ppm to 15000 ppm, for a predetermined period of time (FIG. 2 (C)) and a second heating step carried out, after the first heating step, at a temperature over 800° C. for a predetermined period of time (FIG. 2 (D)). The firing step also includes a cooling step of cooling the granular material to room temperature (FIG. 2 (E)) after the second heating step is finished.

Figure 3:
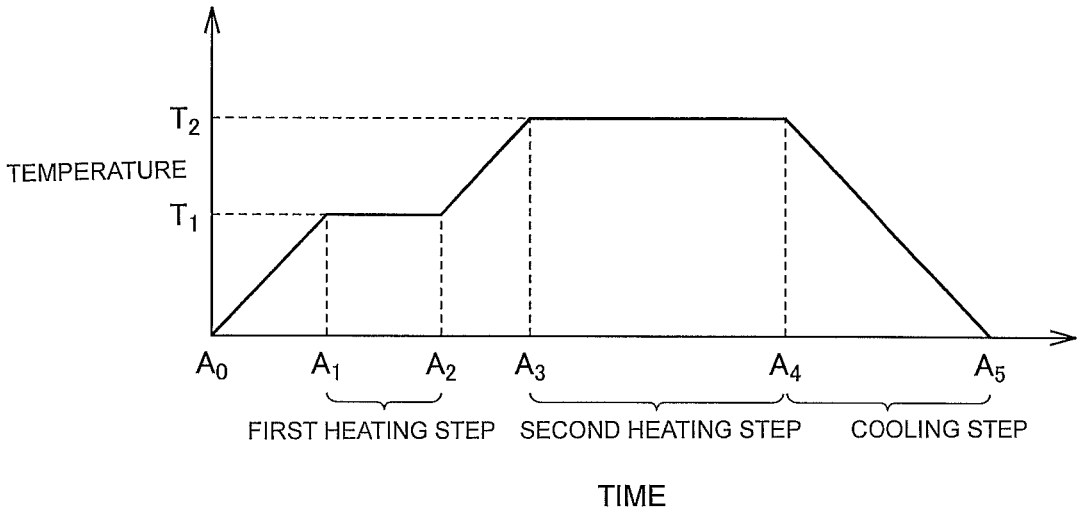
FIG. 3 is a schematic graph showing the relationship between temperature and time in a firing step.

FIG. 3 is a schematic graph showing the relationship between temperature and time in the firing step. With reference to FIG. 3 together with the other drawings, the firing step will be described below.

First, the granular material is raised in temperature by application of heat. For example, a predetermined amount of the granular material is put in a ceramic container and the granular material in the container is placed in a heating furnace. The granular material rises in temperature by increasing the temperature of the heating furnace from room temperature to temperature $T_1$ over a period from time $A_0$ to time $A_1$. In this step, dispersing agents and low-molecular organic substances are decomposed. Then, the granular material particles are partially ferritized over a period from time $A_1$ to time $A_2$ in the first heating step prior to promotion of sintering and ferritization. Concretely, temperature $T_1$ is maintained in a range from 500° C. to 800° C. under an atmosphere with an oxygen concentration of 1000 ppm to 15000 ppm, for a certain period of time from 0.5 to 5 hours.

An oxygen concentration of 1000 ppm or higher is preferable because that concentration can promote ferrite reaction at a temperature of 500° C. or higher. An oxygen concentration of 15000 ppm or lower is also preferable because ferritization can proceed at a temperature of 800° C. or lower, which means that partial ferritization can be made prior to sintering progression. A gas, which is introduced and flows in the furnace, is a mixture of air and nitrogen with an oxygen concentration of 1000 ppm to 15000 ppm.

During time $A_2$ to $A_3$, temperature $T_1$ is raised to temperature $T_2$. This temperature $T_2$ is set to be higher than 800° C. In this description, temperature $T_2$ is set to, for example, from 1000° C. to 1150° C. During time $A_3$ to $A_4$, firing temperature $T_2$ is maintained in a range from 1000° C. to 1150° C. for a predetermined period of time. In this stage, ferritization reaches completion. The oxygen concentration is set to any values as long as the particles can be completely sintered at a firing temperature ranging from 1000° C. to 1150° C. To this end, the oxygen concentration can be set to 50000 ppm or lower. The predetermined period of time is determined according to the amount of the granular material, particle diameter, and other factors. In this embodiment, for example, 5 to 30 hours are selected.

When sintering has been completed after a lapse of the predetermined period of time, the particles are cooled down from temperature $T_2$ to room temperature, approximately 25° C., over a period from time $A_4$ time $A_5$. This cooling step can be done by natural cooling, that is, by stopping heating to lower the temperature to room temperature level, or by cooling the particles in lower temperature atmosphere step by step.

This cooling step also can be done in an atmosphere with an oxygen concentration of 5000 to 20000 ppm. More specifically, a gas with an oxygen concentration of 5000 to 20000 ppm is introduced and continues flowing during the cooling step.

The carrier core particles manufactured in this manner can have a high oxygen content in the spinel crystal structure in an inner layer thereof. If the oxygen concentration is lower than 5000 ppm, the oxygen content in the crystal structure in the inner layer of the particles relatively decreases. On the other hand, if the oxygen concentration is higher than 20000 ppm, the carrier core particles are not composed of a single layer, but contain $Fe_2O_3$ or the like remaining as unreacted substances. This may result in degradation of the magnetization of the carrier core particles, which is magnetic characteristic degradation of the carrier core particles. Therefore, it is preferable to cool the material in the aforementioned range of oxygen concentration.

It is preferable at this stage to control the particle size of the sintered material that has been cooled down to room temperature. For example, the sintered material is coarsely ground by a hammer mill or the like. In other words, the sintered granules are disintegrated (FIG. 2 (F)). After disintegration, classification is carried out with a vibrating sieve or the like. In other words, the disintegrated granules are classified. This classification step is a second classification step (FIG. 2 (G)). Through these steps, carrier core particles having a desired size can be obtained.

Then, the classified granules undergo oxidation (FIG. 2(H)). The surfaces of the carrier core particles obtained at this stage are heat-treated (oxidized) to increase the particle's breakdown voltage, thereby imparting appropriate electric resistance to the carrier core particles. This can prevent carrier scattering caused by charge leakage. The oxidation step does not need to be performed according to electric resistance or other characteristics required to the carrier core particles. In short, the oxidation step can be omitted as needed.

More specifically, the granules are oxidized in an atmosphere with an oxygen concentration of 10% to 100%, at a temperature of 200° C. to 700° C., for 0.1 to 24 hours to obtain the target carrier core particles. More preferably, the granules are placed at a temperature of 250° C. to 600° C. for 0.5 to 20 hours, further more preferably, at a temperature of 300° C. to 550° C. for 1 to 12 hours.

Thus, the carrier core particles according to the embodiment of the invention are manufactured. Specifically, the method for manufacturing carrier core particles for electrophotographic developer according to the embodiment of the invention is a method for manufacturing carrier core particles which include manganese, magnesium, calcium, and iron as a core composition. The method includes a granulation step of granulating a mixture of raw materials containing manganese, magnesium, calcium, and iron with a reducing agent added at a ratio of 0.10 to 1.00% by mass to the total mass of the raw materials containing manganese, magnesium, calcium, and iron, and a firing step of firing the granular material granulated in the granulation step. The firing step includes a first heating step of applying heat at a constant temperature ranging from 500° C. to 800° C. in an atmosphere with an oxygen concentration of 1000 ppm to 15000 ppm for a predetermined period of time and a second heating step of applying heat at a temperature higher than 800° C. for a predetermined period of time after the first heating step.

Next, the carrier core particles obtained in the aforementioned manner are coated with resin (FIG. 2(I)). Specifically, the carrier core particles obtained according to the invention are coated with silicone-based resin, acrylic resin or the like. This coating can impart charging characteristics and improve durability and resultantly provides carrier for electrophotographic developer. The silicone-based resin, acrylic resin or other coating materials can be applied through a well-known coating method. The carrier for electrophotographic developer according to the embodiment of the invention is used in developer to develop electrophotographic images and includes the above-described carrier core particles for electrophotographic developer and resin that coats the surface of the carrier core particles for electrophoto graphic developer.

Next, predetermined amounts of the carrier and toner are mixed (FIG. 2(J)). Specifically, the carrier for electrophotographic developer according to the invention is mixed with an appropriate well-known toner. In this manner, the electrophotographic developer according to the invention can be achieved. The carrier and toner are mixed by any type of mixer, for example, a ball mill. The electrophotographic developer according to the embodiment of the invention includes the above-described carrier for electrophotographic developer and toner that can be triboelectrically charged by frictional contact with the carrier for development of electrophotographic images.

Figure 4:
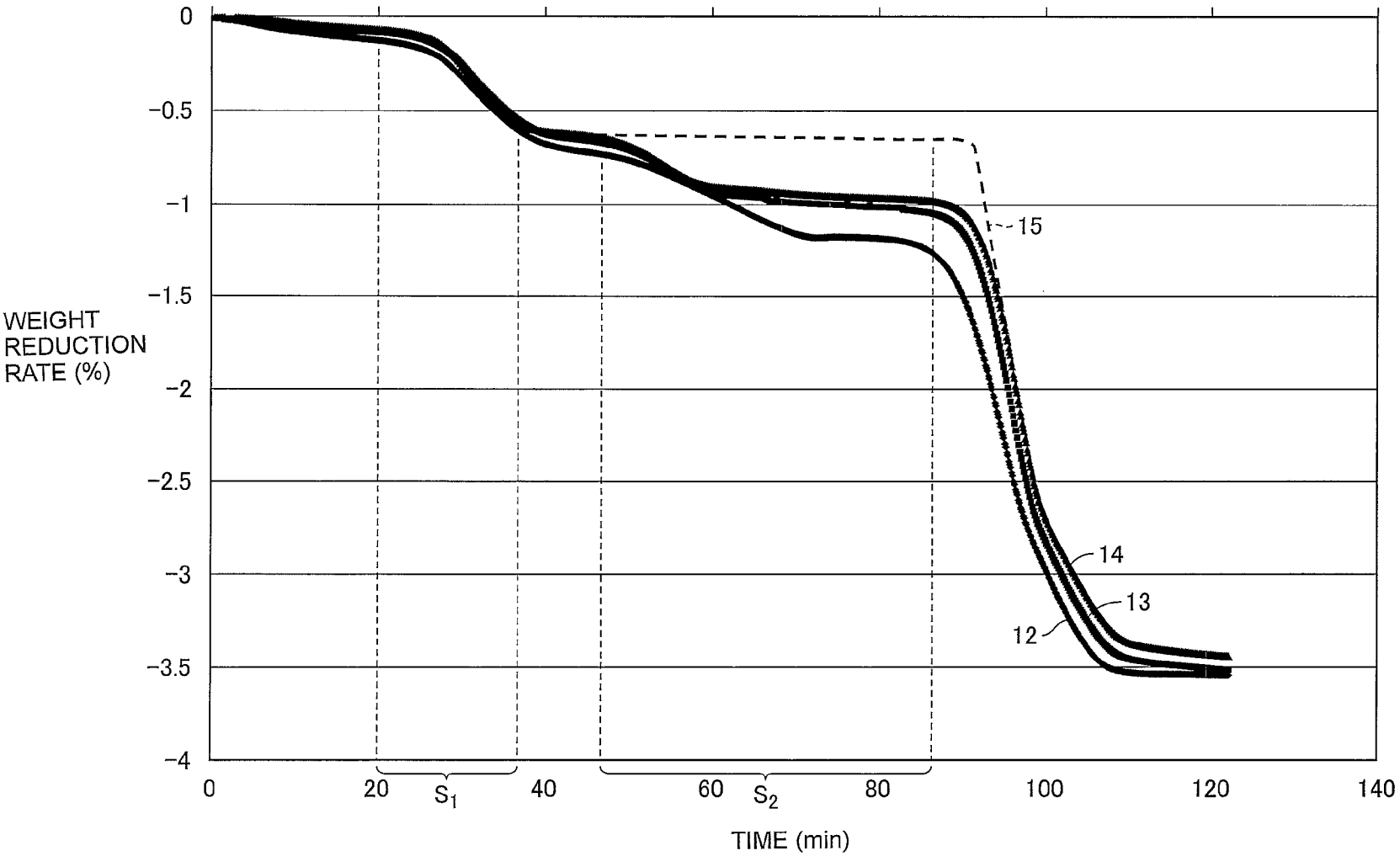
FIG. 4 is a graph showing the relationship between oxygen concentration and weight reduction rate in the firing step.

Now, consideration will be given to the reaction in the firing step. FIG. 4 is a graph showing the relationship between oxygen concentration and weight reduction rate, which is obtained through thermogravimetric analysis, in the firing step. In FIG. 4, the vertical axis represents weight reduction rate (%), while the horizontal axis represents elapsed time (minute). FIG. 4 shows how the weight changes during the firing step. The minus figures along the vertical axis of the graph represent how much the weight is reduced.

Vaporization of organic substances in the firing step occurs mainly in an area $S_1$ in FIG. 4. Lines 12, 13, 14 in FIG. 4 denote granular materials containing a reducing agent and heated at an oxygen concentration of 1000 ppm, 5000 ppm, and 15000 ppm, respectively, in the first heating step, while a dotted line 15 denotes a granular material not containing the reducing agent and heated at an oxygen concentration of 5000 ppm in the first heating step.

Reaction to yield ferrite containing manganese and magnesium, in other words, manganese-magnesium ferrite in a general firing step is represented by chemical equation (1) below.

$$MgO+\tfrac{1}{3}Mn_3O_4+Fe_2O_3=MnMgFe_2O_4+\tfrac{2}{3}O_2 \quad (1)$$

In the case where reaction occurs as represented by chemical equation (1), the reaction begins at around 900° C. when the oxygen concentration is, for example, 1000 ppm. Thus, the reducing agent is basically not needed to cause ferritization just as it is not needed for magnetite. However, carrier core particles obtained through such reaction leave many gaps and voids therein. If the firing temperature is increased or the firing time is extended to fill the gaps and voids in the carrier core particles, appropriate irregularities may not be formed on the surface of the carrier core particles. It means that the carrier core particles may have smooth surfaces and a wide range of crystallinity variation.

On the other hand, reaction to yield magnetite in the firing step is represented by chemical equation (2) below.

$$Fe_2O_3=\tfrac{2}{3}Fe_3O_4+\tfrac{1}{6}O_2 \quad (2)$$

In the case of chemical equation (2), the reaction begins at around 1250° C. when the oxygen concentration is, for example, 1000 ppm. Thus, reactions as represented by the following chemical equations (3), (4), (5) are provoked by adding a reducing agent and setting temperature in a range from 500° C. to 800° C. to induce ferritization.

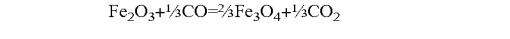

$$Fe_2O_3+\tfrac{1}{6}C=\tfrac{2}{3}Fe_3O_4+\tfrac{1}{6}CO_2 \quad (3)$$

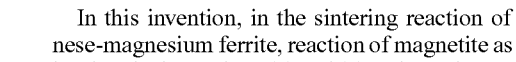

$$Fe_2O_3+\tfrac{1}{3}CO=\tfrac{2}{3}Fe_3O_4+\tfrac{1}{3}CO_2 \quad (4)$$

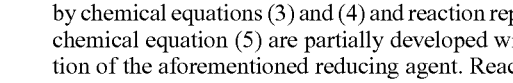

$$C+O_2=CO_2 \quad (5)$$

In this invention, in the sintering reaction of the manganese-magnesium ferrite, reaction of magnetite as represented by chemical equations (3) and (4) and reaction represented by chemical equation (5) are partially developed with the addition of the aforementioned reducing agent. Reactions represented by the following chemical equations (6) and (7) are also promoted.

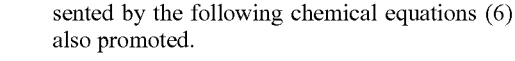

$$Mn_3O_4+\tfrac{1}{2}C=3MnO+\tfrac{1}{2}CO_2 \quad (6)$$

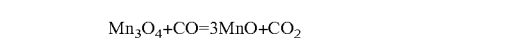

$$Mn_3O_4+CO=3MnO+CO_2 \quad (7)$$

Magnetite yielded through the reactions as represented by chemical equations (3), (4) and (5) or MnO yielded through the reactions as represented by chemical equations (6) and (7) are used to promote ferritization of manganese-magnesium ferrite as represented by, for example, the following chemical equations (8), (9), and (10).

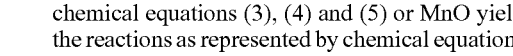

$$MgO+\tfrac{1}{3}Mn_3O_4+\tfrac{2}{3}Fe_3O_4=MnMgFe_2O_4+\tfrac{1}{2}O_2 \quad (8)$$

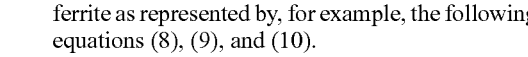

$$MgO+MnO+\tfrac{2}{3}Fe_3O_4=MnMgFe_2O_4+\tfrac{1}{3}O_2 \quad (9)$$

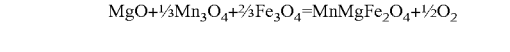

$$MgO+MnO+Fe_2O_3=MnMgFe_2O_4+\tfrac{1}{2}O_2 \quad (10)$$

Referring now to FIG. 4, the weight indicated by the dotted line 15 decreases at a stage where the organic substances vaporize and then significantly drops after a lapse of about 90 minutes. Actually, the weight decreases in two steps. In other words, weight reduction does not take place in an area $S_2$ where 50 to 80 minutes have passed from the start in FIG. 4. On the contrary, the weight indicated by the lines 12, 13, 14 decreases in the area $S_1$ where the organic substances vaporize, then decreases again in the area $S_2$ where 50 to 80 minutes have passed from the start, and subsequently the weight significantly drops after a lapse of about 90 minutes. Actually, the weight decreases in three steps. The weight reduction in the second step is probably caused by a decrease of $CO_2$ which is seen in the chemical equations (3), (4) and (5) or the chemical equations (6) and (7).

According to the present invention, an additive as a reducing agent is added and the oxygen concentration is controlled in the first heating step of the firing step to perform partial ferritization, thereby promoting sintering reaction in the inner part of the carrier core particles and forming appropriate irregularities on the surface of the carrier core particles.

In the above-described embodiment, calcium is contained in the core composition; however, the present invention is not limited thereto, and a core composition without calcium can be adopted.

EXAMPLES

Example 1

30.61 kg of $Fe_2O_3$, 13.16 kg of $Mn_3O_4$, 1.02 kg of MgO, and 0.22 kg (220 g) of $CaCO_3$ were mixed by a vibration mill, and the mixture was then calcined at 900° C. in air atmosphere for 2 hours. Then, the calcined material was pulverized by a vibration mill until its volume mean diameter reached 1.5 μm and remaining material on a sieve of 45 μm became 0.5% by mass or less. The pulverized material was used as a calcined material. 12.5 kg of the calcined material was dispersed in 4 kg of water, and 74 g of ammonium polycarboxylate-based dispersant and 38 g of carbon black reducing agent were added to make a mixture. The solid concentration of the mixture was measured and resulted in 75% by mass. The mixture was pulverized by a wet ball mill (media diameter: 2 mm) to obtain mixture slurry. The carbon black content to the total mass of the mixture slurry is 0.30% by mass.

A brief description will be given below on how to calculate the content of carbon black, i.e., the content ratio of the carbon black.

First, the total amount of the materials is calculated. 38 g (amount of carbon black added)+74 g (amount of dispersant added)+12500 g (amount of calcined material)=12612 g (total amount of materials)

Second, the content of the carbon black is calculated from the total amount of the materials.

Content of carbon black=38 g×100/12612 g=0.30% by mass

The content (%) of the carbon black is obtained in this manner. Note that the materials in this embodiment are to contain calcium.

The slurry was sprayed into hot air of approximately 130° C. by a spray dryer and turned into dried granulated powder. At this stage, granulated powder particles out of the target particle size distribution were removed by a sieve. The remaining granulated powder was loaded in an electric furnace to be heated at an oxygen concentration of 5000 ppm, at a temperature of 500° C. for 1 hour in the first heating step. Subsequently, the granulated powder was heated at an oxygen concentration of 5000 ppm, at a temperature of 1095° C. for 3 hours in the second heating step to sinter the granulated powder. During the heating steps, gas was controlled to flow in the electric furnace such that the oxygen concentration in the atmosphere inside the electric furnace was maintained at 5000 ppm. The sintered powder was disintegrated and then classified by a sieve to obtain carrier core particles, of Example 1, having a mean particle diameter of 25 μm.

The physical properties, electrical properties, and actual machine performance of the obtained carrier core particles are shown in Tables 1, 2, and 3. The physical properties include BET specific surface area ($m^2/g$), pore volume ($cm^3/g$), true density before pulverization (g/ml), true density after pulverization (g/ml), and volume porosity (%), while the electrical properties include charge amount (μC/g). Measurement of the physical properties and so on will be described later. This is also applied to the following examples.

Example 2

The carrier core particles of Example 2 were obtained in the same manner as Example 1; however, the first heating step was performed at an oxygen concentration of 5000 ppm, at a temperature of 800° C. for 1 hour. The physical properties, electrical properties, and actual machine performance of the obtained carrier core particles are shown in Tables 1 to 3

Example 3

The carrier core particles of Example 3 were obtained in the same manner as Example 1; however, the first heating step was performed at an oxygen concentration of 5000 ppm, at a temperature of 500° C. for 0.5 hours. The physical properties, electrical properties, and actual machine performance of the obtained carrier core particles are shown in Tables 1 to 3

Example 4

The carrier core particles of Example 4 were obtained in the same manner as Example 1; however, the first heating step was performed at an oxygen concentration of 5000 ppm, at a temperature of 500° C. for 5 hours. The physical properties, electrical properties, and actual machine performance of the obtained carrier core particles are shown in Tables 1 to 3.

Example 5

The carrier core particles of Example 5 were obtained in the same manner as Example 1; however, the first heating step was performed at an oxygen concentration of 1000 ppm, at a temperature of 500° C. for 1 hour. The physical properties, electrical properties, and actual machine performance of the obtained carrier core particles are shown in Tables 1 to 3.

Example 6

The carrier core particles of Example 6 were obtained in the same manner as Example 1; however, the first heating step was performed at an oxygen concentration of 15000 ppm, at a temperature of 500° C. for 1 hour. The physical properties, electrical properties, and actual machine performance of the obtained carrier core particles are shown in Tables 1 to 3.

Example 7

The carrier core particles of Example 7 were obtained in the same manner as Example 1; however, the carbon black added as a reducing agent to make a mixture was 13 g. The physical properties, electrical properties, and actual machine performance of the obtained carrier core particles are shown in Tables 1 to 3. The content of the carbon black in the total mass of the mixture was 0.10% by mass.

Example 8

The carrier core particles of Example 8 were obtained in the same manner as Example 1; however, the carbon black added as a reducing agent to make a mixture was 127 g. The physical properties, electrical properties, and actual machine performance of the obtained carrier core particles are shown in Tables 1 to 3. The content of the carbon black in the total mass of the mixture was 1.00% by mass.

Example 9

The carrier core particles of Example 9 were obtained in the same manner as Example 1; however, calcium was not added. The physical properties, electrical properties, and actual machine performance of the obtained carrier core particles are shown in Tables 1 to 3.

Example 10

The carrier core particles of Example 10 were obtained in the same manner as Example 1; however, the starting materials were changed to 31.8 kg of $Fe_2O_3$, 10.6 kg of $Mn_3O_4$, 2.39 kg of MgO, and 0.22 kg (220 g) of $CaCO_3$. The physical properties, electrical properties, and actual machine performance of the obtained carrier core particles are shown in Tables 1 to 3.

Comparative Example 1

The carrier core particles of Comparative Example 1 were obtained in the same manner as Example 1; however, the first heating step was performed at an oxygen concentration of 5000 ppm, at a temperature of 300° C. for 1 hour. The physical properties, electrical properties, and actual machine performance of the obtained carrier core particles are shown in Tables 1 to 3.

Comparative Example 2

The carrier core particles of Comparative Example 2 were obtained in the same manner as Example 1; however, the first heating step was performed at an oxygen concentration of 5000 ppm, at a temperature of 900° C. for 1 hour. The physical properties, electrical properties, and actual machine performance of the obtained carrier core particles are shown in Tables 1 to 3.

Comparative Example 3

The carrier core particles of Comparative Example 3 were obtained in the same manner as Example 1; however, the first heating step was not performed. The physical properties, electrical properties, and actual machine performance of the obtained carrier core particles are shown in Tables 1 to 3

Comparative Example 4

The carrier core particles of Comparative Example 4 were obtained in the same manner as Example 1; however, the first heating step was performed at an oxygen concentration of 25000 ppm, at a temperature of 500° C. for 1 hour. The physical properties, electrical properties, and actual machine performance of the obtained carrier core particles are shown in Tables 1 to 3.

Comparative Example 5

The carrier core particles of Comparative Example 5 were obtained in the same manner as Example 1; however, carbon black as a reducing agent was not added. The physical properties, electrical properties, and actual machine performance of the obtained carrier core particles are shown in Tables 1 to 3. The content of the carbon black in the total mass of a mixture was 0.00% by mass.

Comparative Example 6

The carrier core particles of Comparative Example 6 were obtained in the same manner as Example 1: however, the carbon black added as a reducing agent to make a mixture was 153 g. The physical properties, electrical properties, and actual machine performance of the obtained carrier core particles are shown in Tables 1 to 3. The content of the carbon black in the total mass of the mixture was 1.20% by mass.

If the core compositions of Examples 1 to 10 and Comparative Examples 1 to 6 are represented as $(Mn_xMg_yCa_z)Fe_{3-x-y-z}O_4$, the ratio of each ingredient of the core composition of the carrier core particles can be represented as follows.

The ratio of the ingredients in the core composition of Examples 1 to 8 and Comparative Examples 1 to 6 is: x=0.85, y=0.14, z=0.01, and 3-x-y-z=1.99. The ratio of the ingredients in the core composition of Example 9 that does not contain calcium is: x=0.85, y=0.14, z=0.00, and 3-x-y-z=2.01. The ratio of the ingredients in the core composition of Example 10 is: x=0.67, y=0.32, z=0.01, and 3-x-y-z=2.00.

TABLE 1

| | raw material | | | | | first heating step | | | second heating step | | | cooling step | core composition | | | |
|---|---|---|---|---|---|---|---|---|---|---|---|---|---|---|---|---|
| | calcined powder kg | carbon black g | carbon black mass % | water kg | dispersant g | temperature ° C. | holding time time | oxygen concentration ppm | temperature ° C. | holding time time | oxygen concentration ppm | oxygen concentration ppm | x | y | z | 3 − x − y − z |
| Example 1 | 12.5 | 38 | 0.30 | 4 | 74 | 500 | 1 | 5000 | 1095 | 3 | 5000 | 20000 | 0.85 | 0.14 | 0.01 | 1.99 |
| Example 2 | 12.5 | 38 | 0.30 | 4 | 74 | 800 | 1 | 5000 | 1095 | 3 | 5000 | 20000 | 0.85 | 0.14 | 0.01 | 1.99 |
| Example 3 | 12.5 | 38 | 0.30 | 4 | 74 | 500 | 0.5 | 5000 | 1095 | 3 | 5000 | 20000 | 0.85 | 0.14 | 0.01 | 1.99 |
| Example 4 | 12.5 | 38 | 0.30 | 4 | 74 | 500 | 5 | 5000 | 1095 | 3 | 5000 | 20000 | 0.85 | 0.14 | 0.01 | 1.99 |
| Example 5 | 12.5 | 38 | 0.30 | 4 | 74 | 500 | 1 | 1000 | 1095 | 3 | 5000 | 20000 | 0.85 | 0.14 | 0.01 | 1.99 |
| Example 6 | 12.5 | 38 | 0.30 | 4 | 74 | 500 | 1 | 15000 | 1095 | 3 | 5000 | 20000 | 0.85 | 0.14 | 0.01 | 1.99 |
| Example 7 | 12.5 | 13 | 0.10 | 4 | 74 | 500 | 1 | 5000 | 1095 | 3 | 5000 | 20000 | 0.85 | 0.14 | 0.01 | 1.99 |
| Example 8 | 12.5 | 127 | 1.00 | 4 | 74 | 500 | 1 | 5000 | 1095 | 3 | 5000 | 20000 | 0.85 | 0.14 | 0.01 | 1.99 |
| Example 9 | 12.5 | 38 | 0.30 | 4 | 74 | 500 | 1 | 5000 | 1095 | 3 | 5000 | 20000 | 0.85 | 0.14 | 0.00 | 2.01 |
| Example 10 | 12.5 | 38 | 0.30 | 4 | 74 | 500 | 1 | 5000 | 1095 | 3 | 5000 | 20000 | 0.67 | 0.32 | 0.01 | 2.00 |
| Comparative Example1 | 12.5 | 38 | 0.30 | 4 | 74 | 300 | 1 | 5000 | 1095 | 3 | 5000 | 20000 | 0.85 | 0.14 | 0.01 | 1.99 |
| Comparative Example2 | 12.5 | 38 | 0.30 | 4 | 74 | 900 | 1 | 5000 | 1095 | 3 | 5000 | 20000 | 0.85 | 0.14 | 0.01 | 1.99 |
| Comparative Example3 | 12.5 | 38 | 0.30 | 4 | 74 | — | — | 5000 | 1095 | 3 | 5000 | 20000 | 0.85 | 0.14 | 0.01 | 1.99 |
| Comparative Example4 | 12.5 | 38 | 0.30 | 4 | 74 | 500 | 1 | 25000 | 1095 | 3 | 5000 | 20000 | 0.85 | 0.14 | 0.01 | 1.99 |
| Comparative Example5 | 12.5 | 0 | 0.00 | 4 | 74 | 500 | 1 | 5000 | 1095 | 3 | 5000 | 20000 | 0.85 | 0.14 | 0.01 | 1.99 |
| Comparative Example6 | 12.5 | 153 | 1.20 | 4 | 74 | 500 | 1 | 5000 | 1095 | 3 | 5000 | 20000 | 0.85 | 0.14 | 0.01 | 1.99 |

TABLE 2

| | BET specific surface area $m^2/g$ | pore volume $cm^3/g$ | true density before pulverization g/ml | true density after pulverization g/ml | volume porosity % | charge amount μC/g |
|---|---|---|---|---|---|---|
| Example 1 | 0.204 | 0.013 | 4.85 | 4.96 | 2.2 | 10.9 |
| Example 2 | 0.192 | 0.012 | 4.82 | 4.96 | 2.8 | 10.2 |
| Example 3 | 0.213 | 0.016 | 4.83 | 4.96 | 2.6 | 10.8 |
| Example 4 | 0.180 | 0.013 | 4.82 | 4.96 | 2.8 | 10.5 |
| Example 5 | 0.175 | 0.011 | 4.84 | 4.96 | 2.4 | 10.3 |
| Example 6 | 0.220 | 0.016 | 4.83 | 4.96 | 2.6 | 10.5 |
| Example 7 | 0.228 | 0.020 | 4.82 | 4.97 | 3.0 | 10.4 |
| Example 8 | 0.146 | 0.005 | 4.84 | 4.96 | 2.4 | 10.3 |
| Example 9 | 0.201 | 0.016 | 4.82 | 4.96 | 2.8 | 10.0 |
| Example 10 | 0.200 | 0.012 | 4.80 | 4.92 | 2.4 | 10.1 |

TABLE 2-continued

| | BET specific surface area $m^2/g$ | pore volume $cm^3/g$ | true density before pulverization g/ml | true density after pulverization g/ml | volume porosity % | charge amount μC/g |
|---|---|---|---|---|---|---|
| Comparative Example 1 | 0.180 | 0.022 | 4.67 | 4.95 | 5.7 | 6.5 |
| Comparative Example 2 | 0.165 | 0.021 | 4.73 | 4.98 | 5.0 | 7.2 |
| Comparative Example 3 | 0.201 | 0.023 | 4.70 | 4.99 | 5.2 | 6.4 |
| Comparative Example 4 | 0.221 | 0.025 | 4.73 | 4.97 | 4.8 | 6.5 |
| Comparative Example 5 | 0.265 | 0.030 | 4.72 | 4.96 | 4.8 | 6.8 |
| Comparative Example 6 | 0.121 | 0.004 | 4.70 | 4.96 | 5.2 | 6.7 |

TABLE 3

| | image evaluation (initial stage) | | | | | image evaluation (100K copies) | | | | | image evaluation (200K copies) | | | | |
|---|---|---|---|---|---|---|---|---|---|---|---|---|---|---|---|
| | image density | fog | white spot | fine line reproducibility | image quality | image density | fog | white spot | fine line reproducibility | image quality | image density | fog | white spot | fine line reproducibility | image quality |
| Example 1 | 1.41 | 0.001 | ◎ | ◎ | ◎ | 1.42 | 0.001 | ◎ | ◎ | ◎ | 1.38 | 0.002 | ◎ | ○ | ◎ |
| Example 2 | 1.42 | 0.001 | ◎ | ◎ | ◎ | 1.41 | 0.002 | ◎ | ◎ | ◎ | 1.38 | 0.003 | ◎ | ○ | ◎ |
| Example 3 | 1.38 | 0.001 | ◎ | ◎ | ◎ | 1.37 | 0.002 | ○ | ◎ | ◎ | 1.35 | 0.003 | ○ | ◎ | ◎ |
| Example 4 | 1.39 | 0.001 | ◎ | ◎ | ◎ | 1.38 | 0.001 | ◎ | ○ | ◎ | 1.33 | 0.002 | ◎ | ○ | ◎ |
| Example 5 | 1.40 | 0.001 | ◎ | ◎ | ◎ | 1.39 | 0.003 | ◎ | ◎ | ○ | 1.35 | 0.004 | ◎ | ◎ | ◎ |
| Example 6 | 1.41 | 0.001 | ◎ | ◎ | ◎ | 1.41 | 0.001 | ◎ | ◎ | ○ | 1.36 | 0.003 | ○ | ◎ | ○ |
| Example 7 | 1.42 | 0.001 | ◎ | ◎ | ◎ | 1.40 | 0.002 | ◎ | ◎ | ○ | 1.35 | 0.003 | ○ | ◎ | ○ |
| Example 8 | 1.42 | 0.001 | ◎ | ◎ | ◎ | 1.41 | 0.001 | ○ | ◎ | ◎ | 1.32 | 0.002 | ◎ | ◎ | ○ |
| Example 9 | 1.39 | 0.001 | ◎ | ◎ | ◎ | 1.38 | 0.002 | ◎ | ◎ | ◎ | 1.33 | 0.003 | ○ | ○ | ◎ |
| Example 10 | 1.40 | 0.001 | ◎ | ◎ | ◎ | 1.39 | 0.001 | ○ | ◎ | ◎ | 1.35 | 0.002 | ◎ | ○ | ◎ |
| Comparative Example 1 | 1.35 | 0.001 | ◎ | ◎ | ○ | 1.25 | 0.006 | ○ | ◎ | Δ | 1.18 | 0.009 | Δ | ○ | X |

TABLE 3-continued

| | image evaluation (initial stage) | | | | | image evaluation (100K copies) | | | | | image evaluation (200K copies) | | | | |
|---|---|---|---|---|---|---|---|---|---|---|---|---|---|---|---|
| | image density | fog | white spot | fine line reproducibility | image quality | image density | fog | white spot | fine line reproducibility | image quality | image density | fog | white spot | fine line reproducibility | image quality |
| Comparative Example 2 | 1.33 | 0.002 | ○ | ◎ | ○ | 1.23 | 0.006 | Δ | ○ | Δ | 1.15 | 0.010 | X | Δ | X |
| Comparative Example 3 | 1.33 | 0.001 | ◎ | ◎ | ○ | 1.25 | 0.007 | ○ | ◎ | Δ | 1.10 | 0.009 | Δ | Δ | X |
| Comparative Example 4 | 1.35 | 0.001 | ○ | ◎ | ○ | 1.23 | 0.005 | ○ | ○ | Δ | 1.05 | 0.008 | Δ | Δ | X |
| Comparative Example 5 | 1.34 | 0.002 | ○ | ◎ | ○ | 1.21 | 0.008 | ○ | ◎ | Δ | 1.13 | 0.010 | Δ | Δ | X |
| Comparative Example 6 | 1.35 | 0.001 | ◎ | ◎ | ○ | 1.20 | 0.008 | ○ | Δ | Δ | 1.02 | 0.009 | Δ | X | X |

The BET specific surface area shown in the tables was measured by using a single-point BET surface area analyzer (produced by Mountech CO., Ltd., Model: Macsorb HM model-1208). Specifically, samples, each of which weighed in at 8.500 g, were loaded to a 5-ml (cc) cell that was then degassed at 200° C. for 30 minutes to measure the BET specific surface area thereof.

Pore volume was measured as follows. The test machine used was POREMASTER-60GT produced by Quantachrome Instruments. Specifically, samples, each of which weighed in at 1.200 g, were loaded to a 5-ml (cc) cell to measure the pore volumes under the following conditions: cell stem volume: 0.5 ml; head pressure: 20 PSIA; surface tension of mercury: 485.00 erg/cm$^2$; contact angle of mercury: 130.00 degrees; high-pressure measurement mode: fixed rate; motor speed: 1; and high-pressure measurement range: 20.00 to 10000.00 PSI. The pore volume was determined by subtracting volume A (ml/g) at 100 PSI from volume B (ml/g) at 10000.00 PSI.

Measurement of true densities before and after pulverization and volume porosity of the carrier core particles was conducted as follows. The powder samples were pulverized for 120 minutes in a vibratory ball mill (balls were zirconia balls with a diameter of ϕ5). The density was measured before and after pulverization. The instrument used to measure the true density of the carrier core particles before and after pulverization was a gas displacement type pycnometer (Ultrapyc 1000 produced by Quantachrome Instruments).

Evaluation of the volume porosity of the carrier core particles was made based on pores that were obtained from the difference between the true densities of the carrier core particles before and after pulverization. Specifically, the volume porosity was calculated from the equation below. The volume porosity is represented by P, the true density of the carrier core particles before pulverization is ρ1, and the true density after pulverization is ρ2. The details of a method for measuring the volume porosity of the carrier core particles are disclosed in Japanese Unexamined Patent Application Publication No. 2008-232817.

$$P(\%)=(\rho 2-\rho 1)\times 100/\rho 2$$

The item "charge amount" in Table 2 denotes amounts of charge held by carrier core particles. Measurement of the charge amount will be described below. 9.5 g of the carrier core particles and 0.5 g of toner for commercial full-color copying machines were put in a 100-ml glass bottle with a cap and the bottle was placed in an environment at 25° C. and 50 RH % for 12 hours to control the moisture. The toner in use was cyan toner came with imagio MP C5000 manufactured by Ricoh Company, Ltd. The moisture-controlled carrier core particles and toner were shaken for 30 minutes by a shaker and mixed. The shaker in use was a model NEW-YS produced by YAYOI CO., LTD., and operated at a shaking speed of 200/min and at an angle of 60°. From the mixture of the carrier core particles and toner, 500 mg of the mixture was weighed out and measured for the charge amount by a charge measurement apparatus. In this embodiment, the measurement apparatus in use was a model STC-1-C1 produced by JAPAN PIO-TECH CO., LTD., and operated at a suction pressure of 5.0 kPa with a suction mesh made of SUS and with 795 mesh. Two samples of the same were measured and the average of the measured values was defined as the core charge amount. The core charge amount was calculated by the following formula: core charge amount (μC (coulomb)/g)=measured charge (nC)×10$^3$×coefficient (1.0083×10$^{-3}$)÷toner weight (weight before suction (g)−weight after suction (g)).

Evaluation using an actual machine was conducted as follows. First, silicone resin (SR2411 produced by Dow Corning Toray Co., Ltd.) was dissolved in toluene to obtain a coating resin solution. Then, the carrier core particles and the prepared resin solution in a 9:1 weight ratio were loaded in an agitator that agitated and heated the carrier core particles immersed in the resin solution for 3 hours at a temperature of 150° C. to 250° C.

The agitation applied silicone-based resin over the carrier core particles at a ratio of 1.0 mass % relative to the weight of each carrier core particle. The resin-coated carrier core particles were placed in a circulating hot air oven, heated at 250° C. for 5 hours to cure the coating resin layer, thereby obtaining carrier for electrophotographic developer according to Example 1.

The carrier particles and toner particles with a diameter of approximately 5 μm were mixed in a pot mill for a predetermined period of time to obtain two-component electrophotographic developer associated with Example 1. With the two-component electrophotographic developer and a digital reversal development-type test machine operable at a copy speed of 60 copies per minute, evaluation of each item was made at the initial stage, after formation of 100K copies, and after formation of 200K copies. Carrier core particles of Examples 2 to 9 and Comparative Examples 1 to 6 were subjected to the same steps to obtain carrier associated with Example 2 and the remaining examples and electrophotographic developers associated with Example 2 and the remaining examples. Note that "K" denotes 1000. For example, "100K copies" means "100000 copies" and "200K copies" means "200000 copies".

(1) Evaluation of Image Density and Fog Level

With a 60-copies-per-minute test machine, the two-component electrophotographic developers were evaluated for image density. Specifically, evaluation of image density was made by measuring the density of 10 solid black image areas by a reflection densitometer (manufactured by Tokyo Denshoku.co., Ltd.). Acceptable values of image density were set to 1.20 or higher.

Evaluation of fog level was made by measuring the density of 10 solid white image areas and then subtracting the density of a blank white paper from the average of the measured density values. Acceptable values of the fog level were set to below 0.006.

(2) Evaluation of White Spot

With the 60-copies-per-minute test machine, the two-component electrophotographic developers were evaluated for carrier scattering. Specifically, the carrier scattering (white spots) present on an image was evaluated on a one to four scale as follows. The results are shown in Table 3.

◎ (very good): a level in which there are no white spots on each of 10 sheets of A3-size paper.

○ (good): a level in which there are 1 to 5 white spots on each of 10 sheets of A3-size paper.

Δ (fair): a level in which there are 6 to 10 white spots on each of 10 sheets of A3-size paper.

× (poor): a level in which there are 11 or more white spots on each of 10 sheets of A3-size paper.

(3) Evaluation of Fine Line Reproducibility

With the 60-copies-per-minute test machine, the two-component electrophotographic developers were evaluated for fine line reproducibility. Specifically, the fine line reproducibility on images was evaluated on a one to four scale as follows. The results are shown in Table 3.

The electrophotographic developers were rated on a scale of Very good ◎ (double circle); Good ○ (circle); Usable Δ (triangle); and Unusable × (cross) on the evaluation criteria. The scale "Good (○)" is equivalent to a level of currently, commercially practical, high performance electrophotographic developer, and therefore electrophotographic developers rated as "Good (○)" or higher are judged as passable.

(4) Image Quality

With the 60-copies-per-minute test machine, the two-component electrophotographic developers were evaluated for image quality on a one to four scale as follows. The results are shown in Table 3.

◎ (very good): The test image was well reproduced.

○ (good): The test image was mostly reproduced.

Δ (fair): The test image was not mostly reproduced.

× (poor): The test image was not at all reproduced.

Figure 5:
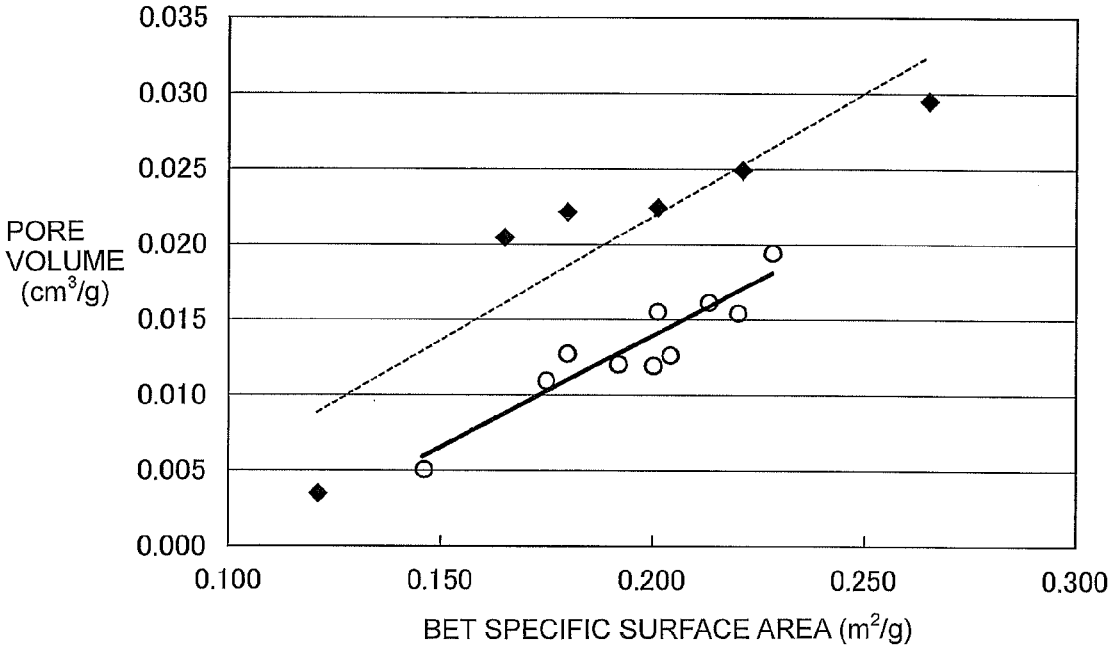
FIG. 5 is a graph showing the relationship between pore volume and BET specific surface area of carrier core particles.

For reference purpose, a graph showing the relationship between pore volume and BET specific surface area of the carrier core particles is shown in FIG. 5. In FIG. 5, the vertical axis represents pore volume ($cm^3/g$), while the horizontal axis represents BET specific surface area ($m^2/g$). FIG. 5 indicates Examples 1 to 10 by open circles and Comparative Examples 1 to 6 by solid black diamonds. The pore volume values plotted in FIG. 5 are numbers with four digits to the right of the decimal point.

By referring to Tables 1 and 2 and FIG. 5, the carrier core particles of Examples 1 to 10 all exhibit pore volumes ranging from 0.005 $cm^3/g$ to 0.020 $cm^3/g$ and BET specific surface areas ranging from 0.140 $m^2/g$ to 0.230 $m^2/g$. On the other hand, the carrier core particles of Comparative Examples 1 to 5 exhibit BET specific surface areas ranging from 0.165 to 0.265 $m^2/g$, but their pore volumes are all higher than 0.020 $cm^3/g$. These values probably suggest that there are many gaps and voids in the carrier core particles. The carrier core particles of Comparative Example 6 have a BET specific surface area of 0.121 $m^2/g$, which is very high. This value probably suggests that the carrier core particles do not have appropriate irregularities on the surfaces, but are smooth.

Regarding the carrier core particles of all Examples, except for Examples 7 and 8, the pore volume values fall in a range of 0.010 $cm^3/g$ to 0.016 $cm^3/g$ and the BET specific surface area values fall in a range of 0.175 $m^2/g$ to 0.220 $m^2/g$. Therefore, the carrier core particles within the ranges have excellent properties.

It can be said that Examples plotted in an area on the right down side of a solid line in FIG. 5, which is determined by calculation from Examples, have relatively small pore volumes and large BET specific surface areas and therefore have excellent properties. The area in relation to the solid line is expressed by $y \leq 0.14x - 0.012$ where the pore volume is y ($cm^3/g$) and the BET specific surface area is x ($m^2/g$).

Figure 6:
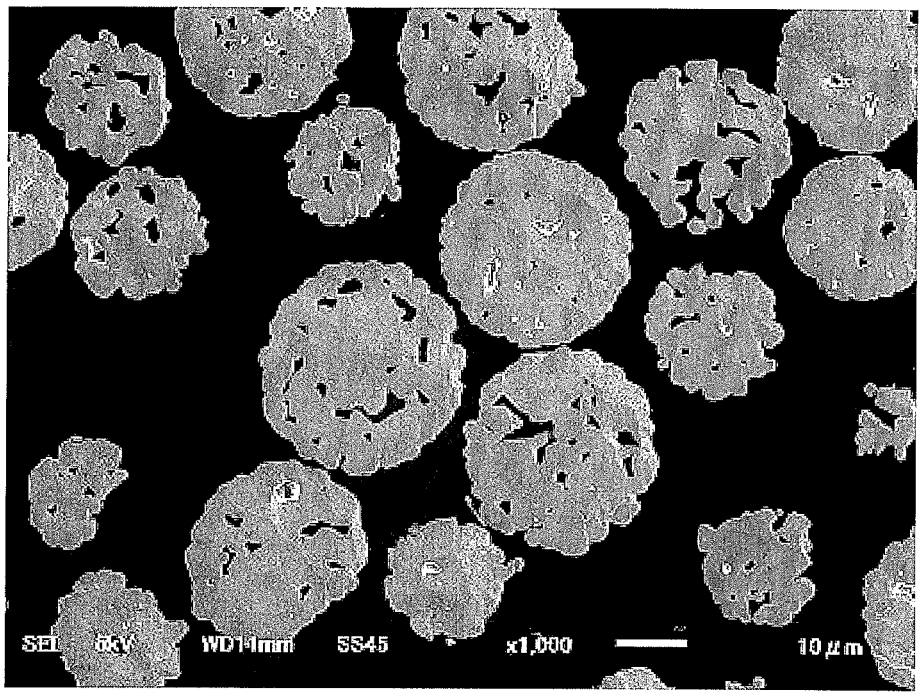
FIG. 6 is an electron micrograph showing the cross section of the carrier core particles of Example 1.
Figure 7:
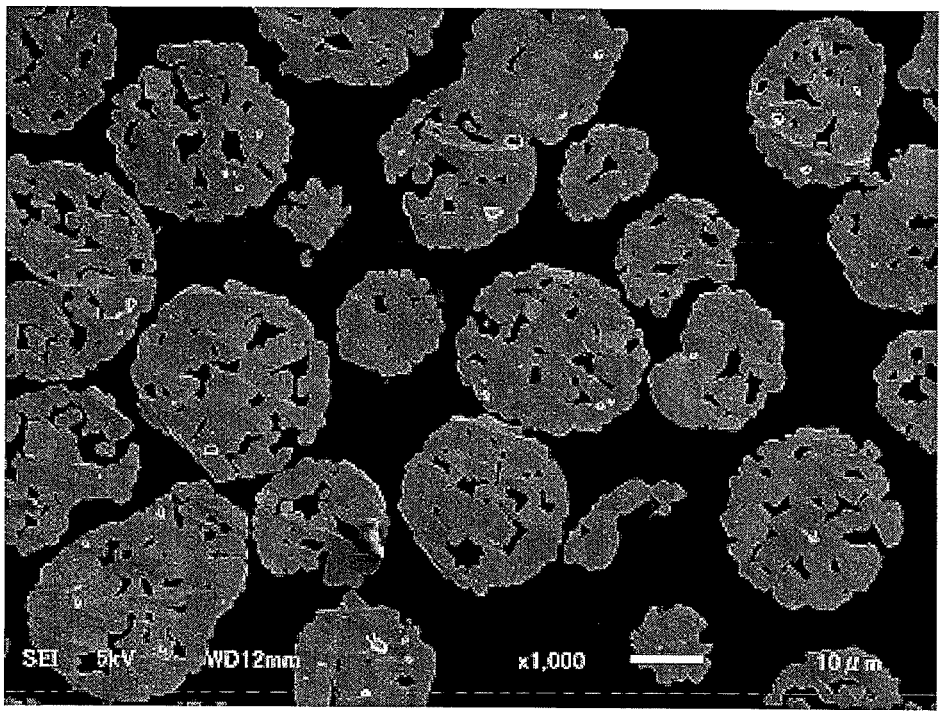
FIG. 7 is an electron micrograph showing the cross section of carrier core particles of Comparative Example 1.
Figure 8:
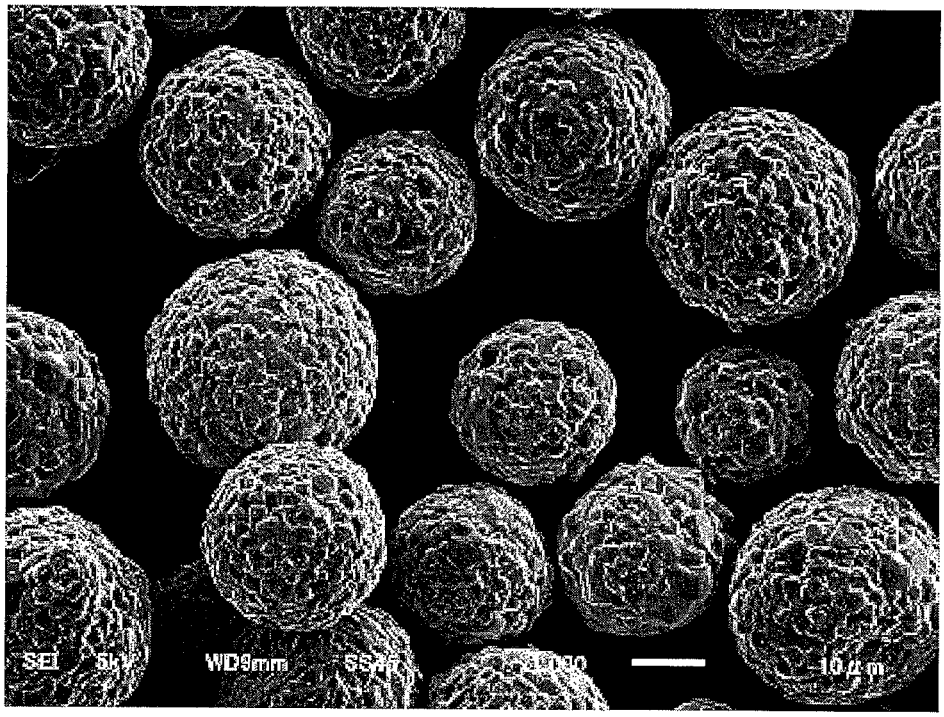
FIG. 8 is an electron micrograph showing the appearance of the carrier core particles of Comparative Example 1.

FIG. 6 is an electron micrograph showing the cross section of the carrier core particles of Example 1. FIG. 7 is an electron micrograph showing the cross section of the carrier core particles of Comparative Example 1. For reference, FIG. 8 is an electron micrograph showing the appearance of the carrier core particles of Comparative Example 1. In FIGS. 6 and 7, black parts in particulate matter are actually gaps and voids in carrier core particles.

Referring to FIGS. 1, 6, 7 and 8, the carrier core particles of Example 1 and Comparative Example 1 are almost identical in appearance, but it is apparent that Comparative Example 1 has more gap and void parts than Example 1.

The volume porosities of Examples 1 to 10 are at least lower than 4.5%, and actually are 3.0% or lower. On the contrary, the volume porosities of Comparative Examples 1, 2, 3, 4, 5 and 6 are 5.7%, 5.0%, 5.2%, 4.8%, 4.8% and 5.2%, respectively. These values indicate that there are many internal pores confined in the carrier core particles and suggest that the carrier core particles are lower in strength than those of Examples 1 to 10. In short, the carrier core particles with volume porosities of at least 4.5% or higher, which are closer values to those of Comparative Examples 1 to 6, show a tendency of strength reduction, which is not preferable.

The values representing charging characteristics of Examples 1 to 10 are 10.0 μC/g at the lowest, which is relatively high. Especially, Examples 1 to 8 and 10, in which calcium is added, exhibit 10.1 μC/g at the lowest. In other words, higher charging characteristics can be obtained by adding calcium. In addition, Examples 1 to 8, which contain Mn at a relatively high ratio in their core compositions, exhibit 10.2 μC/g at the lowest. In other words, higher charging characteristics can be obtained by increasing the Mn content ratio in the core composition. The present invention has achieved highly-chargeable carrier core particles by forming appropriate irregularities on the surface of the carrier core particles, which was not achievable by conventional compositional modification or other conventional techniques. On the other hand, the values representing charging characteristics of Comparative Examples 1, 2, 3, 4, 5 and 6 are 6.5 μC/g, 7.2 μC/g, 6.4 μC/g, 6.5 μC/g, 6.8 μC/g and 6.7 μC/g, respectively, which are relatively low. If the surfaces of the carrier core particles are exposed due to long-term use, such low values may affect actual machine performance.

With reference to Table 2, Examples 1 to 10 and Comparative Examples 1 to 6 have excellent actual-machine performance, i.e., image density, fog level, white spots, fine line reproducibility, and image quality in the initial evaluation. However, in the evaluation after formation of 100K copies, some of Comparative Examples 1 to 6 are inferior to Examples 1 to 10 that are evaluated as excellent in terms of most property items. In the evaluation after formation of 200K copies, Examples 1 to 10 keep themselves in a good state for most of the evaluation items. On the other hand, Comparative Examples 1 to 6 are of an inferior level or an unusable level for most of the evaluation items.

As described above, the method for manufacturing carrier core particles according to the present invention can provide carrier core particles for electrophotographic developer that can make good images over long-term use. In addition, the carrier core particles for electrophotographic developer, carrier for electrophotographic developer and electrophotographic developer according to the invention can provide good images over long-term use.

The foregoing has described the embodiment of the present invention by referring to the drawings. However, the invention should not be limited to the illustrated embodiment. It should be appreciated that various modifications and changes can be made to the illustrated embodiment within the scope of the appended claims and their equivalents.

Industrial Applicability

The method for manufacturing carrier core particles for electrophotographic developer, the carrier core particles for electrophotographic developer, carrier for electrophotographic developer and electrophotographic developer according to the present invention can be effectively used when applied to copying machines or the like that are used for a long time.

REFERENCE SIGNS LIST

11: carrier core particle, 12, 13, 14, 15: line

The invention claimed is:

1. A method for manufacturing carrier core particles for electrophotographic developer including manganese, magnesium, and iron as a core composition, the method comprising the steps of:

granulating a mixture of a raw material containing manganese, a raw material containing magnesium, and a raw material containing iron with a reducing agent added at a ratio of 0.10% to 1.00% by mass to a total mass of the raw materials containing manganese, magnesium, and iron; and firing the granular material granulated in the granulation step, wherein the firing step includes a first heating step of applying heat at a constant temperature ranging from 500° C. to 800° C. in an atmosphere with an oxygen concentration of 1000 ppm to 15000 ppm for a predetermined period of time and a second heating step of applying heat at a temperature higher than 800° C. for a predetermined period of time after the first heating step.

2. The method for manufacturing the carrier core particles for electrophotographic developer according to claim 1, wherein the reducing agent includes a raw material containing carbon.

3. The method for manufacturing the carrier core particles for electrophotographic developer according to claim 2, wherein the raw material containing carbon includes carbon black.

4. The method for manufacturing the carrier core particles for electrophotographic developer according to claim 1, wherein the carrier core particles for electrophotographic developer include calcium as the core composition.

5. The method for manufacturing the carrier core particles for electrophotographic developer according to claim 1, wherein the heating temperature in the second heating step ranges from 1000° C. to 1150° C.

* * * * *